United States Patent [19]

Makishima et al.

[11] Patent Number: 4,518,099

[45] Date of Patent: May 21, 1985

[54] PORTABLE TOOTHPICK CASE

[75] Inventors: Takao Makishima, Suita; Shigeru Inaba, Kawachinagano; Yasuyoshi Wada, Osaka, all of Japan

[73] Assignee: Sunstar Kabushiki Kaisha, Takatsuki, Japan

[21] Appl. No.: 530,098

[22] Filed: Sep. 7, 1983

[30] Foreign Application Priority Data

Sep. 9, 1982 [JP] Japan ..... 57-137265[U]

[51] Int. Cl.[3] ..... A47G 21/12

[52] U.S. Cl. ..... 221/30; 206/380; 221/75

[58] Field of Search ..... 221/30, 75, 78, 77, 221/232, 279; 206/380; 132/89, 93; 198/774

[56] References Cited

U.S. PATENT DOCUMENTS 2,335,670 11/1943 Harvey ..... 221/75 X
3,441,165 4/1969 Zampichelli ..... 206/380 X
3,480,181 11/1969 Bauer ..... 221/279
3,512,628 5/1970 Keough ..... 198/774
3,612,348 10/1971 Thomas ..... 221/279 X

FOREIGN PATENT DOCUMENTS 1101693 3/1961 Fed. Rep. of Germany ..... 132/93

*Primary Examiner*—F. J. Bartuska
*Attorney, Agent, or Firm*—Wegner & Bretschneider

[57] ABSTRACT

A portable toothpick case comprises a flat box-like body composed of a flat base member and a flat cover member and having lengthwisely elongated top and bottom openings on its top and bottom periphery walls; a lid member lengthwisely slidably mounted on the top opening of the body and having a guide plate and an opening for taking out toothpicks contained in the body one by one; a toothpick delivery structure; a movable bottom plate mounted on the bottom opening of the body; and fixing clips for integrally fixing the base and cover members. Toothpicks are inserted into the body through the bottom opening and are taken out one by one by sliding the lid member.

4 Claims, 13 Drawing Figures

PORTABLE TOOTHPICK CASE

The present invention relates to a portable toothpick case which is easily put together and handled.

When a person carries a toothpick so that he can use it at any time, usually, it is put into a pocket of clothes and the like as it is. However, there exists a sanitary problem as well as such a problem that the toothpick becomes unusable because the sharp tip thereof is broken.

In order to solve these problems, the present invention provides a novel portable toothpick case which is easily put together and handled. Particularly, the portable toothpick case of the present invention is suitable for carrying connected flat-plate shaped toothpicks as mentioned hereinafter which consist of plural flat-plate shaped toothpicks arranged in a row each of which has a triangular or a trapezoidal cross-section and is connected with the adjacent toothpicks at their shaft parts. When the connected flat-plate shaped toothpicks are used, one of them is cut off from the remainders.

Basically, the portable toothpick case of the present invention comprises a flat box-like body composed of a flat base member and a flat cover member and having elongate top and bottom openings lengthwisely extended on its top and bottom periphery walls, respectively; a lid member lengthwisely slidably mounted on the top opening of the body and having a means for taking out toothpicks contained in the body one by one; a toothpick delivery means held on the inside wall of the base member which carries toothpicks in the body and sends them out of the body in co-operation with the means for taking out a toothpick; a movable bottom plate mounted on the bottom opening of the body for opening and closing the bottom opening; and a fixing means for integrally fixing the base and cover members.

The case of the present invention has such a size that plural toothpicks, for example, 5 to 10 toothpicks, arranged in a row can be contained sideways in the body.

The lid member has a concave cross-section to form a space lengthwisely elongated therein which has an enough size to contain one toothpick sideways therein and is opened toward the inside of the body. The means for taking out toothpicks is composed of an opening for taking out a toothpick which is provided on the outer surface of the lid member in such a manner that the opening is positioned at the backward end with respect to the sliding direction of the lid member (i.e. the direction to open the lid member) and is communicated to the space in the lid member; a guide plate which is attached to the inner surface of the lid member below the opening to guide a toothpick to pass through the opening; and a projection which is projected toward the inside of the body from the side wall of the lid member adjacent to the inner surface of the flat side wall of the base member.

The toothpick delivery means is composed of a stopper member, a moving member and a supporting member which is incorporated with the moving member, all of which are provided on the inner surface of the flat side wall of the base member in such a manner that they are positioned in the forward part with respect to the sliding direction of the lid member; and a "modified V-shaped" lever which is provided on the inner surface of the flat side wall of the base member in such a manner that it is positioned in the backward part with respect to the sliding direction of the lid member. The stopper member is an elastic deformable elongate strip longitudinally extended from the bottom of the base member toward the inside of the lid member and one end thereof is attached to the bottom of the base member. The other end of the stopper member is positioned in the inside of the base member in such a manner that it is spaced from the inner surface of the base member. The stopper member has at least one nail on the surface thereof facing to the cover member. The moving member is a longitudinally extended elastic deformable elongate strip similar to the stopper member and incorporated with the supporting member which longitudinally movably supports the moving member. The moving member also has at least one nail on the surface thereof facing to the cover member. The supporting member which is incorporated with the moving member is provided in such a manner that, when the lid member is opened, the supporting member comes into contact with the projection of the lid member and is pushed down to longitudinally downwardly (toward the bottom) move the moving member. The lever is pivotally attached to the base member at its middle part and has such an arm length and an angle of the "modified V-shape" that one free end of the arm thereof is engaged with the supporting or moving member and, when the lid member is closed, the other free end is pushed down by the projection of the lid member.

Preferably, the fixing means is composed of bosses provided on the periphery flange parts of the base and cover members and clips which fit in the outer side parts of the body to clamp the base and the cover members.

When the portable toothpick case of the present invention is used, connected flat-shaped toothpicks are inserted sideways into the body of the case through the bottom opening thereof and engaged with the nails of the stopper and moving members and the first one toothpick portion is positioned in the space of the lid member. When the lid member is slid to open it, the guide plate cuts the connection part between the first one toothpick portion and the next toothpick portion to cut off the first portion from the remainders and to guide the first toothpick to the opening for taking out a toothpick. Along with this, the projection of the lid member comes into contact with the supporting member incorporated with the moving member and pushes down the moving member. Since the moving member is elastic and deformable and a series of the connected toothpicks are fixed by engagement thereof with the elastic deformable stopper member, only the moving member moves so that the nail thereof is engaged with the toothpick portion next to the other toothpick portion with which the nail of the moving member has firstly engaged. Then, when the lid member is closed, the projection of the lid member pushes down the free end of the lever and thereby the other end of the lever which is engaged with the supporting member is pushed up to upwardly move the moving member. Along with this, the toothpicks engaged with the nail upwardly move in the distance corresponding to the width of one toothpick portion to insert one toothpick portion into the space in the lid member. By repeating this operation, the toothpicks can be taken out one by one from the case.

The case of the present invention is easily put together because the body is composed of the separate base and cover members and toothpicks can be taken out one by one by merely sliding the lid member to open and close it. Further, it is very convenient in carrying toothpicks and can solve sanitary problem and prevent breakage of toothpicks.

Now, a preferred embodiment of the case of the present invention is illustrated by reference to the accompanying drawings in which.

Figure 1:
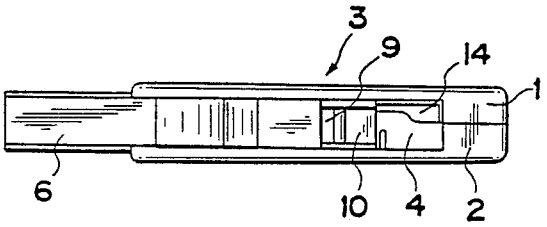
FIG. 1 is a top plan view of an preferred embodiment of the case of the present invention wherein the lid member is opened.
Figure 2:
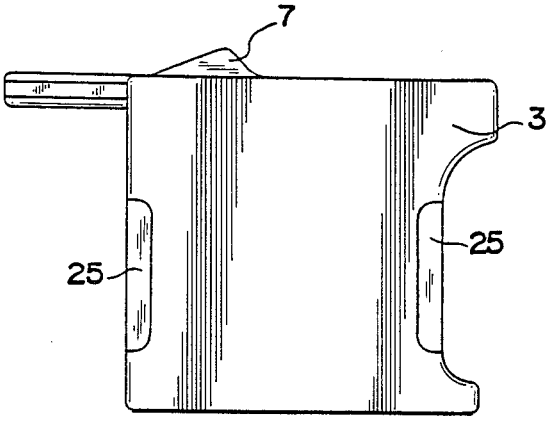
FIG. 2 is a front view of the case shown in FIG. 1.

As is seen from FIGS. 1 to 4, in the portable toothpick case of the present invention, flat base member 1 and flat cover member 2 are combined to from flat box-like body 3. The body has such a size that connected flat-shaped toothpicks can be contained sideways in the body and lengthwisely elongated top opening 4 and bottom opening 5 which are formed by the cutouts of the base member and the cover member are provided at the top and bottom periphery walls of the body.

Figure 5:
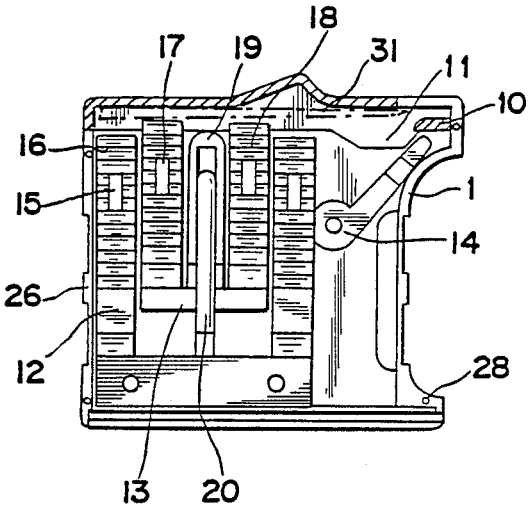
FIG. 5 is a front view of the inside of the base member which illustrates the arrangement of the stopper member, the moving member and the lever in the state that the lid member is closed.
Figure 7:
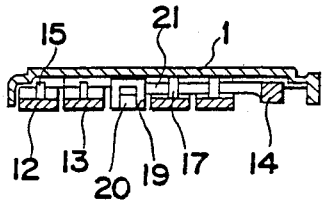
FIG. 7 is a cross-section taken along the line VII—VII in FIG. 6.
Figure 6:
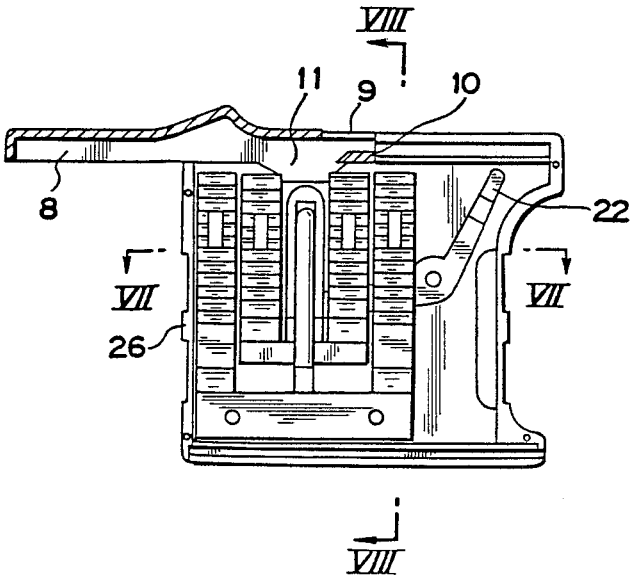
FIG. 6 is a front view of the inside of the base member similar to FIG. 5 which illustrates the arrangement of the members in the state that the lid member is opened.
Figure 8:
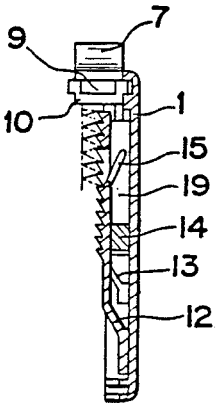
FIG. 8 is a cross-section taken along the line VIII—VIII in FIG. 6.

Lid member 6 having concave cross-section is lengthwisely slidably mounted on top opening 4 by means of engagement between channels and projections. The outer surface of the top wall of the lid member is rises to form knob 7. In the inside of the lid member, lengthwisely elongated space 8 which has an enough size to contain one toothpick sideways therein and is opened toward the inside of the body is formed by the concave cross-section of the lid member. The top and edge walls of lid member 6 at the backward end with respect to the sliding direction of the lid member are cut off so that space 8 is exposed to form opening 9 for taking out a toothpick. Guide plate 10 is provided between lengthwisely extended side walls of lid member 6 at the end of the inside of the lid member where opening 9 is provided. Further, projection 11 is provided in such a manner that it is projected toward the inside of the body from the side wall of the lid member adjacent to the inner surface of the flat side wall of the base member (see FIG. 5). Although, in FIG. 5, the projection is in a trapezoidal shape, it may be in another shape such as a triangular, semicircular or rod shape. The height of the projection is taller than the width of one toothpick portion of connected flat-plate shaped toothpicks.

As is seen form FIGS. 5 to 8, on the inside of the flat side wall of base member 1, there are provided stopper member 12 and moving member 13 in such a manner that they are positioned at the forward part with respect to the sliding direction of lid member 6 and there is provided "modified V-shaped" lever 14 in such a manner that it is positioned at the backward part with respect to the sliding direction of the lid member.

Stopper member 12 is a pair of elongate strips of an elastic deformable synthetic resin which is longitudinally extended from the bottom of the base member toward inside of the lid member and one end thereof is fixed to the bottom of base member 1. The other end of the stopper member is a spaced from the inner surface of the base member by means of spacer 15. Although, in these Figures, spacer 15 is a kind of leaf springs integrally molded with the strips, it may be a spacer made of an elastic deformable material such as sponge fixed on the strips or the inner surface of the base member. Spacer 15 makes elastic deformation of the non-fixed end of stopper member 12 toward the inner surface of the base member possible and assures recovery of deformation. Therefore, if elastic deformation and recovery of deformation of the stopper member itself are sufficient, there is no need to provide spacer 15. Stopper member 12 has plural serrated nails 16 on the surface of strips facing to cover member 2. Each nail 16 is formed in such a manner that the crest thereof extends across the strips and the surface of each nail facing to the lid member is preferably parallel to the inner surface of lid member 6.

Moving member 13 is a U-shaped strip of an elastic deformable synthetic resin provided between a pair of strips of stopper member 12 and is longitudinally extended similar to stopper member 12. One end of the moving member is slidably supported by the inner surface of the flat side wall of base member 1. The other end is spaced from the inner surface of the base member by means of spacer 17 similar to stopper member. Likewise, the spacer may be made of another elastic material and, if elastic deformation and recoverly of deformation of the moving member itself are sufficient, there is no need to provide spacer 17. Moving member also has plural serrated nails 18 as mentioned above on the surface of the strip facing to cover member 2.

Moving member 13 has supporting member 19 incorporated therewith at its middle part. Supporting member 19 is a longitudinally extended elongate rod and has a channel on the surface thereof facing to the cover member. Supporting rod 20 which is incorporated with stopper member 12 and longitudinally extends from its fixed bottom end with spacing from the inner surface of the flat side wall of the base member is inserted into the channel. Thereby, the moving member is longitudinally movably supported by the supporting rod. Supporting member 19 is provided in such a position that it comes into contact with projection 11 of the lid member when lid member 6 is opened. In the accompanying Figures, although supporting member 19 is a rod having a channel, it may be a pipe. Further, supporting rod 20 may be an member separated from the stopper member one end of which is fixed on the base or cover member.

Lever 14 is pivoted at the middle part thereof by a pin projected from the inner surface of the flat side wall of the base member at right angle. The one free end 21 of the lever is engaged with supporting member 19 in such a manner that supporting member 19 is longitudinally moved by movement of lever 14. The other end 22 of lever 14 has such a length and an angle of "modified V-shape" that it is pushed down by projection 11, when lid member 6 is closed. When free end 22 of lever 14 is pushed down, free end 21 is pushed up to longitudinally upwardly move supporting member 19. The angle of lever 14 is determined in such a manner that the moving distance of the supporting member is approximately corresponding to the width of one toothpick portion of the connected flat-plate shaped toothpicks (about 125°). It is possible to directly engage lever 14 with moving member 13.

Figure 3:
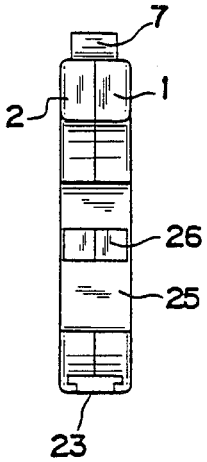
FIG. 3 is a right side view of the case shown in FIG. 1.
Figure 4:
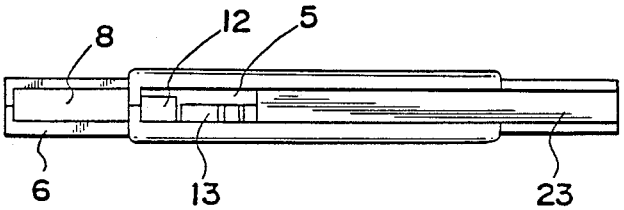
FIG. 4 is a bottom plan view of the case shown in FIG. 1 wherein the bottom plate is opened.

As shown in FIGS. 3 and 4, bottom plate 23 is lengthwisely slidably mounted on bottom opening 5 of body 3 by means of channels.

Figure 10:
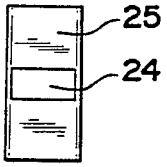
FIG. 10 is a plan view of the clip.
Figure 11:
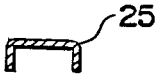
FIG. 11 is a cross-section of the clip.

Rectangular clip 25 as shown in FIGS. 10 and 11 which has a hole 24 at the middle part thereof and U-shaped cross-section is fitted with the side part of the body to integrally fixed base member 1 and cover member 2. Hole 24 of clip 25 is fitted with both projections 26 at flange parts of the base and cover members to further assure integral fixing of both members. In addition, flange parts of base member 1 and cover member 2 has bosses 27 and receiving holes 28 and they also assure integral fixing of both members.

Figure 9:
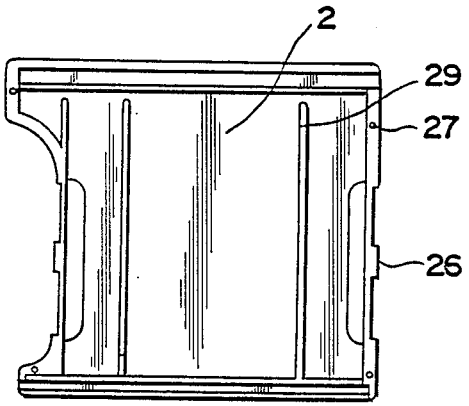
FIG. 9 is a front view of the inside of the cover member.

As shown in FIG. 9, longitudinally extended elongate rib 29 is provided in the inside of the flat side wall of cover member 2. This rib guides the toothpicks and assures engagement them with nail 16 of the stopper member and nail 18 of the moving member.

Figure 12:
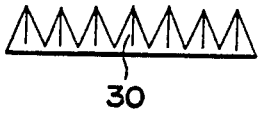
FIG. 12 is an enlarged front view of the connected flat-plate shaped toothpicks to be used for the case of the present invention.
Figure 13:
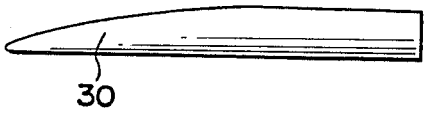
FIG. 13 is an enlarged side view of the connected flat-plate shaped toothpicks.

As shown in FIGS. 12 and 13, the connected flat-plate shaped toothpicks 30 to be used for the case of the present invention are composed of plural flat-plate shaped toothpicks arranged in a row each of which has a triangular or trapezoidal cross-section and is connected with adjacent toothpicks at the shaft parts thereof. For example, the toothpicks can be prepared by crosswisely cutting out plural channels on one surface of a thin plate of which width and thickness are corresponding to the length and the width of one toothpick, respectively, to obtain a plate in the form of teeth of a comb one surface of which is jagged.

When the case of the present invention is used, firstly, bottom plate 23 is opened and connected flat-plate shaped toothpicks 30 are inserted sideways (the sharp tips thereof are directed toward the backward direction with respect to the sliding direction of lid member 6) into body 3 through the bottom opening and the jagged surface thereof is faced to the inside of the base member. When toothpicks 30 are entirely inserted into the body, first toothpick 31 is positioned in space 8 of lid member 6 (see FIG. 5). Nails 16 and 18 are engaged with the gaps between the toothpicks as shown by the chain line in FIG. 8. Since stopper member 12 and moving member 13 are elastic and deformable, toothpicks 30 can be readily inserted into body 3 by lightly pushing to engage them with nails 16 and 18. After insertion of toothpicks 30, bottom plate 23 is closed and the case can be carried as it is.

When the toothpick is taken out from body 3, lid member 6 is opened by sliding. Since toothpick 31 positioned in space 8 is connected to the other toothpicks, it does not move and only lid member 6 moves. By this movement, as shown by the chain line in FIG. 6, guide plate 10 goes into the connecting part of the toothpicks to cut off toothpicks 31 from the other toothpicks and guides toothpicks 31 toward opening 9.

When lid member 6 is opened by sliding, projection 11 of lid member 6 comes into contact with supporting member 19 to push down the member and moving member 13 which is incorporated with the supporting member is also pushed down. At the same time, free end 21 of lever 14 is pushed down and the other free end 22 is pushed up (see FIG. 6). Thus, nail 16 of stopper member 12 which is fixed to base member 1 engages with the toothpicks. Since the upper surface of nail 16 is arranged at right angle to the strip of stopper member 12 and the lower surface of nail 18 of moving member 13 is slanted (see FIG. 8), the entire toothpicks do not move and moving member 13 bends toward the base member and downwardly moves in the distance corresponding to the width of one toothpick to engage nail 18 thereof with the next toothpick.

Further, when lid member 6 is completely opened by sliding, toothpick 31 cut off from the other toothpicks rises at opening 9 by the action of guide plate 10 and thereby the toothpick can be easily taken out from the case and used. In this state, space 8 contains no toothpick.

When lid member 6 is closed by sliding, projection 11 of the lid member comes into contact with free end 22 of lever 14 and pushes down the free end. Then, free end 21 is pushed up and supporting member 19 and moving member 13 which are engaged with the free end move upwardly. Thereby, nail 18 of moving member 13 pushes up the entire toothpicks and the next one toothpick is positioned in space 8 of lid member 6. At this time, stopper member 12 bends toward the base member and recovers to engage nail 16 thereof with the toothpick in the lower position.

In the drawings, nails 16 and 18 of the stopper member and the moving member are provided so that they can engage with the uppermost toothpick and thereby it is possible to take out in turn the toothpicks in the body until the last one. However, since the toothpicks can be pushed upwardly by inserting another series of the connected flat-shaped toothpicks into the body, the position of the nails with respect to the toothpicks can be optionally selected. Further, although nails 16 and 18 have the plural numbers of serrated edges, it is sufficient that they have at least one edge, respectively.

The invention being thus described, it will be obvious that the same way be varied in many ways. Such modifications are not to be regarded as a departure from the spirit and scope of the present invention, and all such modifications are intended to be included within the scope of the following claims.

What is claimed is:

1. A portable toothpick case which comprises a flat box-like body composed of a flat base member and a flat cover member and having elongate top and bottom openings lengthwisely extended on its top and bottom periphery walls, respectively;

a lid member lengthwisely slidably mounted on the top opening of the body and having a concave cross-section and a means for taking out toothpicks contained in the body;

a toothpick delivery means held on the inside wall of the base member;

a movable bottom plate mounted on the bottom opening to open and close the bottom opening; and a fixing means for integrally fixing the base and cover members, said means for taking out toothpicks being composed of an opening for taking out a toothpick provided on the outer surface of one lengthwise end of the lid member, a guide plate provided inside of the lid member below the opening, and a projection projected toward the inside of the body from the side wall of the lid member adjacent to the inner surface of the flat side wall of the base member;

said delivery means being composed of a stopper member, a moving member, a supporting member and a "modified V-shaped" lever provided on the inner surface of the flat side wall of the base member, said stopper member being an elastic deformable elongate strip longitudinally extended from the bottom of the base member with spacing from the inner surface of the inside wall of the base member one end of which is fixed to the bottom of the base member, said moving member being an longitudinally extended elastic deformable elongate strip similar to the stopper member, said supporting member being incorporated with the moving member and longitudinally movably supporting the moving member, and said lever being pivoted at its middle part to the inner surface of the base member and one free end thereof being engaged with the supporting member said stopper member and said moving member having at least one nail on their surface facing to the cover member, respectively;

said lever having such a length of arm and an angle of the "modified V-shape" that the other free end is pushed down by the projection when the lid member is closed by sliding; and said supporting member having such a length that it comes into contact with the projection of the lid member to be pushed down when the lid member is opened by sliding.

2. A portable toothpick case of claim 1 wherein said fixing means is composed of bosses and clips.

3. A portable toothpick case of claim 1 for connected flat-plate shaped toothpicks.

4. A portable toothpick case of claim 2 for connected flat-plate shaped toothpicks.

* * * * *